United States Patent [19]

Johnston

[11] 4,367,908

[45] Jan. 11, 1983

[54] ELECTRICAL CONNECTOR COUPLING

[75] Inventor: James J. Johnston, Old Saybrook, Conn.

[73] Assignee: Akzona Incorporated, Asheville, N.C.

[21] Appl. No.: 156,786

[22] Filed: Jun. 5, 1980

[51] Int. Cl.[3] ..... H01R 13/514

[52] U.S. Cl. ..... 339/154 A; 339/176 M; 339/205

[58] Field of Search ..... 339/154 R, 154 A, 204, 339/205, 49 R, 95 R, 207 R, 207 S, 216 R, 176 M, 260, 95 D

[56] References Cited

U.S. PATENT DOCUMENTS

| | | | |
|---|---|---|---|
| 2,775,746 | 12/1956 | Young | 339/256 |
| 3,324,447 | 6/1967 | Pistey | 339/95 D |
| 3,926,497 | 12/1975 | Eigenbrode | 339/91 R |
| 4,082,409 | 4/1978 | Bailey et al. | 339/182 R |
| 4,095,868 | 6/1978 | Luithle | 339/205 X |
| 4,249,787 | 2/1981 | Welu | 339/204 |
| 4,268,109 | 5/1981 | Hardesty | 339/205 X |
| 4,273,402 | 6/1981 | Hughes | 339/91 R |

*Primary Examiner*—Eugene F. Desmond

*Attorney, Agent, or Firm*—McCormick, Paulding & Huber

[57] ABSTRACT

A coupling member electrically connecting two elongated cables terminated by plug-type connectors has a tubular housing containing a plurality of elongated resilient parallel wire contacts which extend diagonally across the housing bore. The two connectors are plugged into opposite ends of the bore and carry terminals which engage the contacts on opposite sides of the bore axis and bias the contacts to S-shaped configuration. Resilient latch tabs carried by the connectors engaged with retaining shoulders on the housing releasably retain the connectors in snap-in coupled engagement with the coupling member.

16 Claims, 8 Drawing Figures

ELECTRICAL CONNECTOR COUPLING

BACKGROUND OF THE INVENTION

This invention relates in general to electrical couplings and deals more particularly with an improved coupling member for electrically connecting two electrical cables terminated by plug-type connectors in electrically conducting relation to each other. The coupling member of the present invention is particularly suitable for use in coupling modular line cord connectors of miniature plug-type such as are in wide spread use throughout the telecommunication industry. Such plugs are normally mated with miniature jacks and may, for example, be used to terminate a retractile flexible cord which connects a handset and a base of a telephone. Several types of cables are in general use in the industry. Where a high degree of flexibility is required, as in the line cord for a telephone handset, the conductors which comprise the line cord will generally be tensiled or multiple strand wire. In other situations where cable may not be subjected to repeated flexure a cable comprising solid conductors may be preferred, as for example in long wire circuit distribution. Further, 2, 3 and 4 pair cables of flat or circular cross section are also frequently encountered. Numerous situations arise where it is advantageous to rapidly establish positive electrical connection between either identical or dissimilar electrical cables such as aforedescribed which are terminated by plug-type connectors. The coupling member of the present invention is provided to satisfy this need.

SUMMARY OF THE INVENTION

In accordance with the present invention a coupling member is provided for joining two electrical cables terminated by plug-type connectors and wherein each of the connectors has at least one electrical terminal externally exposed at an end thereof. The coupling member comprises an axially elongated housing which has an axially extending bore therethrough for receiving two electrical connectors in its opposite ends. At least one resilient elongated electrical contact is disposed within the housing and extends generally longitudinally of the housing and diagonally across the bore. Means are provided for securing the opposite ends of the one electrical contact within the housing for limited movement relative to the housing. Means are also provided for securing each of the connectors within an associated portion of the bore with its one terminal in registry with the one contact to bias the one terminal into and maintain it in electrically contacting engagement with the one contact.

DETAILED DESCRIPTION OF PREFERRED EMBODIMENT

Figure 1:
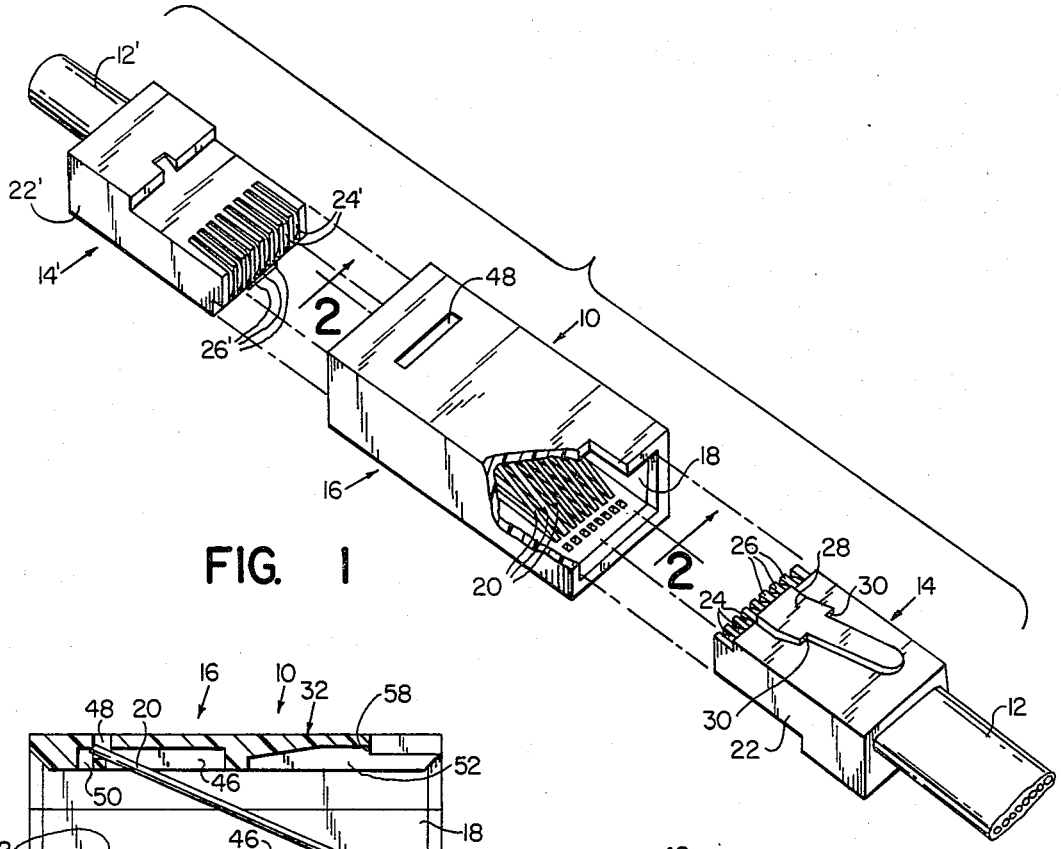
FIG. 1 is an exploded perspective view of a coupling member embodying the present invention shown with a portion of its housing broken away and plug-type connectors aligned in plugging relation with the coupling member.
Figure 2:
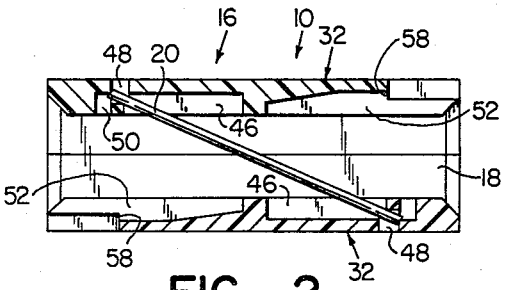
FIG. 2 is a longitudinal sectional view through the coupling member taken along the line 2—2 of FIG. 1.

Turning now to the drawings and referring first particularly to FIG. 1, a coupling member embodying the present invention is indicated generally by the reference numeral 10. The coupling member 10 may be used to join electrical cables of various types which are terminated by plug-type connectors. However, for purpose of illustration, the coupling member 10 is shown in exploded relation to a flat circuit distribution cable 12 terminated by a plug-type connector indicated generally at 14 and an electrical line cord 12' of circular cross section terminated by another plug-type connector indicated generally at 14'. The illustrated coupling member 10 generally comprises an axially elongated housing indicated generally at 16 which has a bore 18 extending axially through it. At least one elongated electrical contact 20 which is disposed within the housing extends generally longitudinally of the housing and generally diagonally across the bore 18. The opposite ends of the contact 20 are supported by the housing for limited movement relative to it. The housing 10 further includes means for securing each of the connectors 14 and 14' in an associated end of the bore 18, all of which will be hereinafter more fully discussed.

Before further considering the coupling member 10 the connectors will be more fully described. A typical connector, for example, the connector 14 is of a well known type in wide spread use in the telecommunication industry and has a generally rectangular dielectric casing 22 which is securely attached to the circuit distribution cable 12. A plurality of electrical terminals 24, 24, which are molded or otherwise secured within the casing 22, are each connected to an associated insulated electrical conductor contained within the jacketed cable 12. Externally exposed portions of the terminals 24, 24 are disposed within parallel slots 26, 26 at the forward or free end of the casing 22. The connector 14 further includes a latching member or resilient latch tab 28 which is integrally connected to the casing 22 near its forward end and which is normally inclined rearwardly and away from the casing. A pair of rearwardly facing latching shoulders 30, 30 are formed on the latching member 28, as best shown in FIG. 1.

Disclosures of other plug-type connectors which may be used with a coupling member embodying the present invention are found in U.S. Pat. No. 3,617,982, issued Nov. 2, 1971 to Hardesty and U.S. Pat. No. 3,699,498, issued Oct. 17, 1972 to Hardesty et al, which are hereby adopted by reference as part of the present disclosure.

Figure 6:
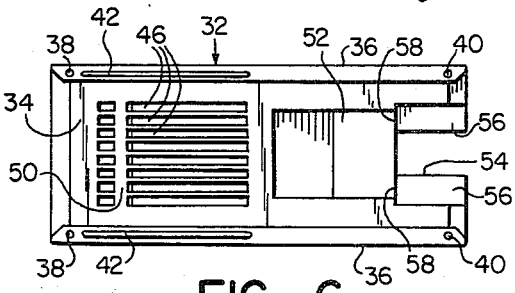
FIG. 6 is a plan view of a typical half section of a coupling member housing.
Figure 7:
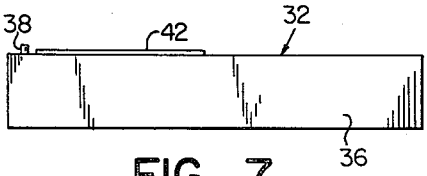
FIG. 7 is a side elevational view of the housing half section shown in FIG. 6.
Figure 3:
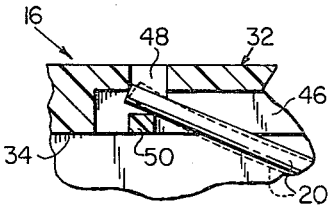
FIG. 3 is a somewhat enlarged fragmentary sectional view of the coupling member as it appears in FIG. 2.
Figure 8:
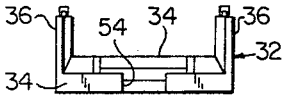
FIG. 8 is a right end elevational view of the housing half section, as it appears in FIGS. 6 and 7.

Considering now the coupling member 10 in further detail, the illustrated housing 16 is generally rectangular. The bore 18 which extends coaxially through it has chamfered openings at its opposite ends and a rectangular cross section which generally complements the rectangular cross section of at least an associated portion of each of the two connectors 14 and 14' which are received within it. Preferably, and as shown the housing 16 is formed from two substantially identical half sections which are joined in an axial plane. A typical housing half section shown in FIGS. 6–8 and designated generally by the numeral 32 is molded from dielectric plastic material. The half section 32, as oriented in FIGS. 6 and 7, has a bottom wall 34 and a pair of transversely spaced apart and longitudinally extending side walls 36, 36 which extend upwardly from the bottom wall. Each side wall 36 has an integral locating dowel 38 which projects upwardly near one of its ends and a dowel receiving aperture 40 near its opposite end. An integral rib 42 extends along a portion of the upper surface of each side wall 36, substantially as shown, for a purpose which will be hereinafter further discussed. A plurality of parallel troughs or grooves 46, 46 formed in a left hand portion of the bottom wall 34 open inwardly through the inner surface of the bottom wall, as best shown in FIG. 6. The number of grooves 46, 46 may vary, however, the illustrated coupling member 10 is provided with eight electrical contacts 20, 20 and it is for this reason that the half sections 32, 32 from which the housing 16 is formed are provided with eight grooves 46, 46 to accommodate the eight contacts. A transversely extending slot 48 opens through the outer surface of the bottom wall 34 and communicates with each groove 46 near its outer end, as best shown in FIG. 3. The outer wall 34 has an integral rib portion 50 which is spaced inwardly of the slot 48 and which extends generally across the grooves 46, 46, as best seen with reference to FIGS. 3 and 6.

In the right hand end of the outer wall 34, as it appears in FIG. 6, there is formed a locking recess 52 which opens inwardly through the inner surface of the outer wall 34. The recress 52 communicates with a rectangular notch 54 which opens outwardly through the right hand end of the wall, as shown in FIG. 6. A pair of guide surfaces 56, 56 which define the opposite sides of the notch 54 are spaced below the inner surface of the wall 34 and above the bottom wall of the recess 52. Vertically disposed and longitudinally inwardly facing latching shoulders 58, 58 extend between the bottom wall of the recess 52 and the guide surfaces 56, 56.

The two half sections 32, 32 which comprise the housing 16 are joined together in edge to edge relation so that the notches 54, 54 are disposed at opposite sides and opposite ends of the housing 16. The contacts 20, 20 are preferably made from equal lengths of high tensile wire which is or may be plated with gold over nickel. In assembly, the end portions of each wire are disposed within associated grooves 46, 46 in opposite walls of the housing. The grooves 46, 46 retain the wire contacts in substantially parallel spaced apart relation to extend longitudinally of the housing and generally diagonally of the bore 18. The rectilinear wire contacts 20, 20 are so dimensioned that an end portion of each wire contact is trapped within an associated groove 46 by a rib 50, substantially as shown in FIG. 3. Each slot 48 cooperates with its associated rib 50 so that the end portions of the wire contacts 20, 20 retained by the rib are supported for limited movement relative to the housing 16, as will be hereinafter further discussed.

After the opposite end portions of the wire contacts 20, 20 have been properly positioned within the slots 46, 46, the two half sections 32, 32 which comprise the housing are joined in assembly. The half sections may be joined in edge to edge relation by a suitable adhesive, but preferably an ultrasonic welding process is employed whereby the associated side edges of the half sections are integrally joined. The dowel pins 38, 38 cooperate with the apertures 40, 40 to assure positive alignment of the two half sections 32, 32. The ribs 42, 42 comprise energy direction ribs which provide focal points for energy concentration to assure effective ultrasonic welds between the parts while maintaining desired dimensional tolerances.

Figure 4:
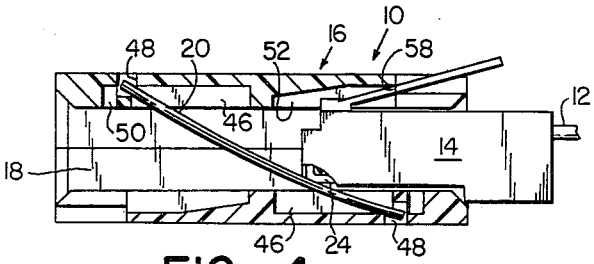
FIG. 4 is similar to FIG. 2 but shows one connector releasably secured in coupled engagement with the coupling member.
Figure 5:
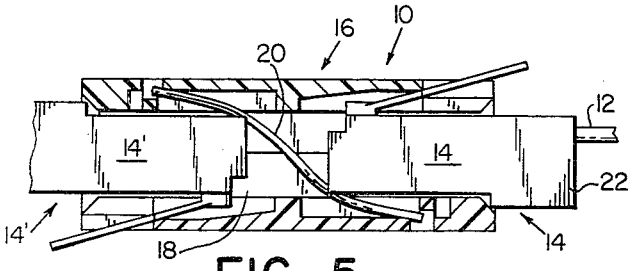
FIG. 5 is similar to FIG. 2 but shows two connectors releasably secured in coupled engagement with the coupling member.

Considering now the manner in which the coupling member 10 is used to join a pair of plug-type connectors, such as the connectors 14 and 14', and referring particularly to FIGS. 4 and 5, the connector 14 is inserted into an associated end of the housing 16 with its latching tab 28 in alignment with an associated notch 34. The chamfer around the opening in the end of the housing aids in insertion of the plug connector 14. The coupling member 10 is dimensioned so that the terminals 24, 24 exposed at the end of the casing 22 are in registry with the contacts 20, 20 and brought into biasing engagement with the contacts when the connector 14 is fully inserted into the housing. It should be noted that the locking recess 52 and notch 54 cooperate with the locking tab 28 to properly register the connector 14 with the coupling member 10 and thereby limit angular orientation of the connector with respect to the housing bore 18. When the connector 14 is fully inserted into the coupling member 10 the locking shoulders 30, 30 on the latching tab 28 snap into engagement with associated retaining shoulders 58, 58 on the housing whereby to releasably retain the connector 14 in connected engagement with the coupling member. Further referring to FIG. 4 it will be noted that the terminals 24, 24 engage respectively associated contacts 20, 20 at one side of the housing axis and cause deflection or bowing of the various contacts 20, 20. As each contact is deflected one or both of its end portions will move slightly with respect to the housing 16, as best shown in FIG. 3. It is for this reason that the contacts 20, 20 are supported at opposite ends for limited movement relative to the housing.

In like manner, the other connector 14' is inserted into the opposite end of the coupling member 10 with its latch tab properly oriented with respect to an associated notch 54. When the second connector 14' is fully inserted into the housing 16 the resilient latch tab 28' snaps into retaining engagement with associated latching shoulders 58, 58 on the housing. The terminals 24', 24' associated with the connector 14' engage the contacts 20, 20 at the opposite side of the bore axis from the contacts 24, 24 and exert biasing force on the various contacts which deflect or bow the contacts in an opposite direction, as shown in FIG. 5. Since both end portions of the various contacts 20, 20 are supported for free limited movement within the housing 16, as shown in FIG. 3, the various contacts 20, 20 readily assume generally S-shaped configuration under the combined biasing force exerted thereon by the two connectors 14 and 14'. More specifically, each slot 48 cooperates with its associated rib 50 to retain the end portion of a contact 20 for free limited movement such as shown in full and broken lines in FIG. 3. As each terminal is brought into biasing engagement with an associated contact 20 slight wiping action occurs therebetween whereby positive electrical contact of high integrity is established. The coupling member is dimensioned so that substantial S-shaped deflection of the contacts occur within the limits of permissible deflection and without the occurrence of set. Substantial potential energy is thereby imparted to the contacts to assure maintenance of high integrity contact engagement for a prolonged period even under conditions of hostile environment.

I claim:

1. A coupling member for joining two electrical cable connectors in electrically conducting relation to each other, each of the connectors having a plurality of electrical terminals externally exposed at an end thereof, said coupling member comprising an axially elongated housing having an axially extending bore therethrough for receiving the two electrical connectors in opposite ends thereof, a plurality of resilient elongated parallel electrical contacts disposed within said housing and extending generally longitudinally of said housing and diagonally across said bore, means securing the opposite ends of said one electrical contact within said housing for limited movement relative to said housing, and means for securing each of said connectors within an associated end portion of said bore with the terminals thereof in registry with said contacts to bias each of the terminals into and maintain it in electrically contacting engagement with an associated one of said contacts.

2. A coupling member as set forth in claim 1 wherein said parallel contacts are inclined to an axial plane.

3. A coupling member as set forth in either claim 1 or claim 2 wherein said connectors have first registration means thereon and said housing has second registration means for cooperating with said first registration means to limit angular orientation of the connectors within said bore.

4. A coupling member as set forth in claim 3 wherein the first registration means and said second registration means comprise said securing means.

5. A coupling member as set forth in claim 4 wherein the first registration means comprises a latching member on each of the connectors and said second registration means comprise latching recesses in opposite ends of said bore for receiving said latching members therein.

6. A coupling member as set forth in claim 5 wherein said latching recesses are disposed at opposite sides of said bore.

7. A coupling member as set forth in either claim 1 or claim 2 wherein said contacts comprises a rectilinear contacts.

8. A coupling member as set forth in claim 7 wherein said contacts comprise lengths of spring wire.

9. A coupling member as set forth in either claim 1 or claim 2 wherein said housing is formed from two substantially identical half sections.

10. The combination comprising a coupling member, and two electrical cables terminated by plug connectors and joined in electrically conducting relation by said coupling member, each of said connectors having a generally rectangular casing, a plurality of electrical terminals mounted in and externally exposed at one end of said casing, and a latching tab carried by said casing, said coupling member having an axially elongated generally rectangular housing including a generally rectangular bore extending axially therethrough, a plurality of resilient normally rectilinear parallel electrical contacts extending generally longitudinally of said housing and diagonally across said bore, means securing the opposite ends of said contacts within said housing for limited movement relative to said housing, and latching recesses at axially opposite ends of said housing, each of said connectors at least partially received in an associated end portion of said bore, each of said latching tabs engaged within an associated one of said latching recesses, said terminals biased into electrically contacting engagement with said contacts and deflecting said contacts to generally S-shaped configuration.

11. The combination as set forth in claim 10 wherein each of said contacts comprises a length of spring wire having a uniform cross section.

12. A coupling member for joining two electrical cable connectors in electrically conducting relation to each other, each of the connectors having at least one electrical terminal externally exposed at an end thereof, said coupling member comprising an axially elongated housing having an axially extending bore therethrough for receiving the two electrical connectors in opposite ends thereof, at least one resilient elongated electrical contact disposed within said housing and extending generally longitudinally of said housing and diagonally across said bore, means securing the opposite ends of said one electrical contact within said housing for limited movement relative to said housing, and means for securing each of said connectors within an associated portion of said bore with the one terminal thereof in registry with said one contact to bias the one terminal into and maintain it in electrically contacting engagement with said one contact, said one contact being substantially S-shaped in the presence of the connectors within the housing.

13. A coupling member as set forth in claim 12 wherein said contact is substantially straight in the absence of either of the connectors.

14. A coupling member for joining in electrically conducting relation two electrical cables terminated by plug connectors being exposed terminals, said coupling member comprising a housing having a bore extending therethrough, at least one resilient normally rectilinear electrically conductive contact, said contact extending generally longitudinally of said bore and diagonally thereacross, means on said housing for supporting the opposite ends of said contact at opposite sides of said bore, and retaining means for coacting with said plug connectors to retain the connectors in plugging relation within opposite ends of said housing with the terminals in electrically contacting engagement with and biasing relation to said contact, said contact being deflected to generally S-shaped configuration by the terminals when the connectors are in plugging relation with said housing.

15. A coupling member for joining in electrically conducting relation two electrical cables terminated by plug connectors having exposed terminals, said coupling member comprising a housing having a bore extending therethrough, at least one resilient axially elongated normally rectilinear electrically conductive contact extending generally longitudinally of said bore and diagonally thereacross, means for supporting the opposite ends of said contact for limited movement relative to said housing, and retaining means for coacting with said plug connectors to retain the connectors in plugging relation within opposite ends of said housing with the terminals in electrically contacting engagement with and biasing relation to said contact, said contact being deflected to a generally S-shaped configuration by the terminals when the connectors are in plugging relation with said housing.

16. A coupling member for joining in electrically conducting relation two electrical cables terminated by plug connectors having exposed terminals, said coupling member comprising a housing having a generally rectangular bore extending therethrough, a plurality of axially elongated resilient normally rectilinear electrically conductive contacts, each of said contacts having a substantially uniform cross-section throughout its length, said contacts extending generally longitudinally of said bore and diagonally thereacross in generally parallel transversely spaced relation to each other, means on said housing retaining the opposite ends of said contacts at opposite sides of said bore for movement relative to said housing in axial directions and in transverse directions relative to the axes of said contacts, and retaining means for coacting with said plug connectors to retain the connectors in plugging relation within opposite ends of said housing with the terminals in biasing relation to and electrically contacting engagement with said contacts, said contacts being deflected to generally S-shaped configuration by the terminals when the connectors are retained in the housing by said retaining means.

* * * * *